US005720660A

United States Patent [19]

Benedetto et al.

[11] Patent Number: 5,720,660

[45] Date of Patent: Feb. 24, 1998

[54] PROTECTIVE COVER FOR A HEAT REGISTER

[76] Inventors: Geri Benedetto, 201 Parkside Dr.; Rich Jones, 208 Parkside Dr., both of Union, N.J. 07083

[21] Appl. No.: 636,832

[22] Filed: Apr. 23, 1996

[51] Int. Cl.[6] ..... F24F 13/20

[52] U.S. Cl. ..... 454/284; 454/289

[58] Field of Search ..... 55/505; 454/284, 454/289, 290, 307, 309, 370; 138/96 R

[56] References Cited

U.S. PATENT DOCUMENTS

| | | | |
|---|---|---|---|
| 32,897 | 7/1861 | Sexton | 454/290 |
| 2,080,726 | 5/1937 | Lowinger | 454/289 X |
| 2,203,311 | 6/1940 | Sinclair | 454/307 |
| 2,743,660 | 5/1956 | Scherff | 454/289 |
| 5,266,091 | 11/1993 | McDonald | 454/289 X |
| 5,435,781 | 7/1995 | Kitchens | 454/284 |
| 5,525,145 | 6/1996 | Hodge | 454/309 X |

*Primary Examiner*—Harold Joyce
*Attorney, Agent, or Firm*—Ezra Sutton

[57] ABSTRACT

A protective cover for heat registers, heating ducts, cooling vents or the like, including a main panel having an open grid pattern for covering the surface of a register, duct or vent; four side walls connected to the main panel for overlapping the sides of the register, duct or vent; and four gripping members connected to the four side walls respectively for inserting behind the register, duct, or vent to hold the protective cover in place.

11 Claims, 4 Drawing Sheets

PROTECTIVE COVER FOR A HEAT REGISTER

This invention relates to a protective cover for heat registers, ducts and cooling vents. More particularly, this invention relates to a protective cover that slides over a heat register, a duct or a cooling vent and encloses it to make it childproof to prevent injuries.

BACKGROUND OF THE INVENTION

Present heat registers, heat ducts, and cooling vents are typically constructed of light weight sheet metals having the inside edges of the louvers being rough or razor sharp. These rough or razor sharp edges may cause severe finger injuries or cuts, ligament damage, severed digits and the like, to both adults and children. At present, there are no protective-type coverings for heat registers, ducts, and cooling vents. There remains a need for a protective covering that prevents injuries and is easy to install and clean, and may be utilized for all types, sizes and shapes of heat registers, ducts, cooling vents used in homes, and in commercial and industrial applications.

DESCRIPTION OF THE PRIOR ART

A cover for a heat register has been disclosed in the prior art. U.S. Pat. No. 3,232,205 discloses a cover with no openings to close-off a heat register this prior art patent does not teach the structure of the present invention.

None of the prior art patents teach or disclose the structure of the present invention of a child proof protective cover for heat registers, heat ducts, or cooling vents when in operational use.

Accordingly, it is an object of the present invention to provide a protective covering for heat registers, heating ducts, or cooling vents that are childproof, so the covering cannot be pulled off by a child, and which prevents digit/finger injuries.

Another object of the present invention is to provide a protective covering for heat registers, heating ducts, cooling vents and the like, that are easily installed, cleaned, and with minimal labor and cost involved in the maintenance thereof.

Another object of the present invention is to provide a protective covering for heat registers, heating ducts, cooling vents and the like, that can be utilized for all types, sizes, and shapes of systems used in the home, commercial buildings or industrial plants.

Another object of the present invention is to provide a protective covering for heat registers, heating ducts, and cooling vents that may be made of various materials of construction such as wood, plastic, or metal having various shapes of openings within the cover.

A further object of the present invention is to provide a protective covering for heat registers, heating ducts, and cooling vents that may be massed produced in an automated and economical manner and is readily affordable by the consumer.

SUMMARY OF THE INVENTION

The present invention provides a protective cover for heat registers, heating ducts, cooling vents or the like, including a main panel having an open grid pattern for covering the surface of a register, duct or vent; side walls connected to the main panel for overlapping the sides of the register, duct or vent; and gripping members connected to the side walls for inserting behind the register, duct, or vent to hold the protective cover in place. The protective cover can be formed of wood, plastic or metal. The open grid pattern is formed of a mesh material having openings to allow air to pass through and the openings are smaller than a child's fingers. The openings can have the shape of an oval, circle, square, diamond or the like, in which the openings are less than ¼ of an inch in width and length.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED AND

ALTERNATE EMBODIMENTS OF THE PRESENT INVENTION PREFERRED EMBODIMENT 10

Figure 1:
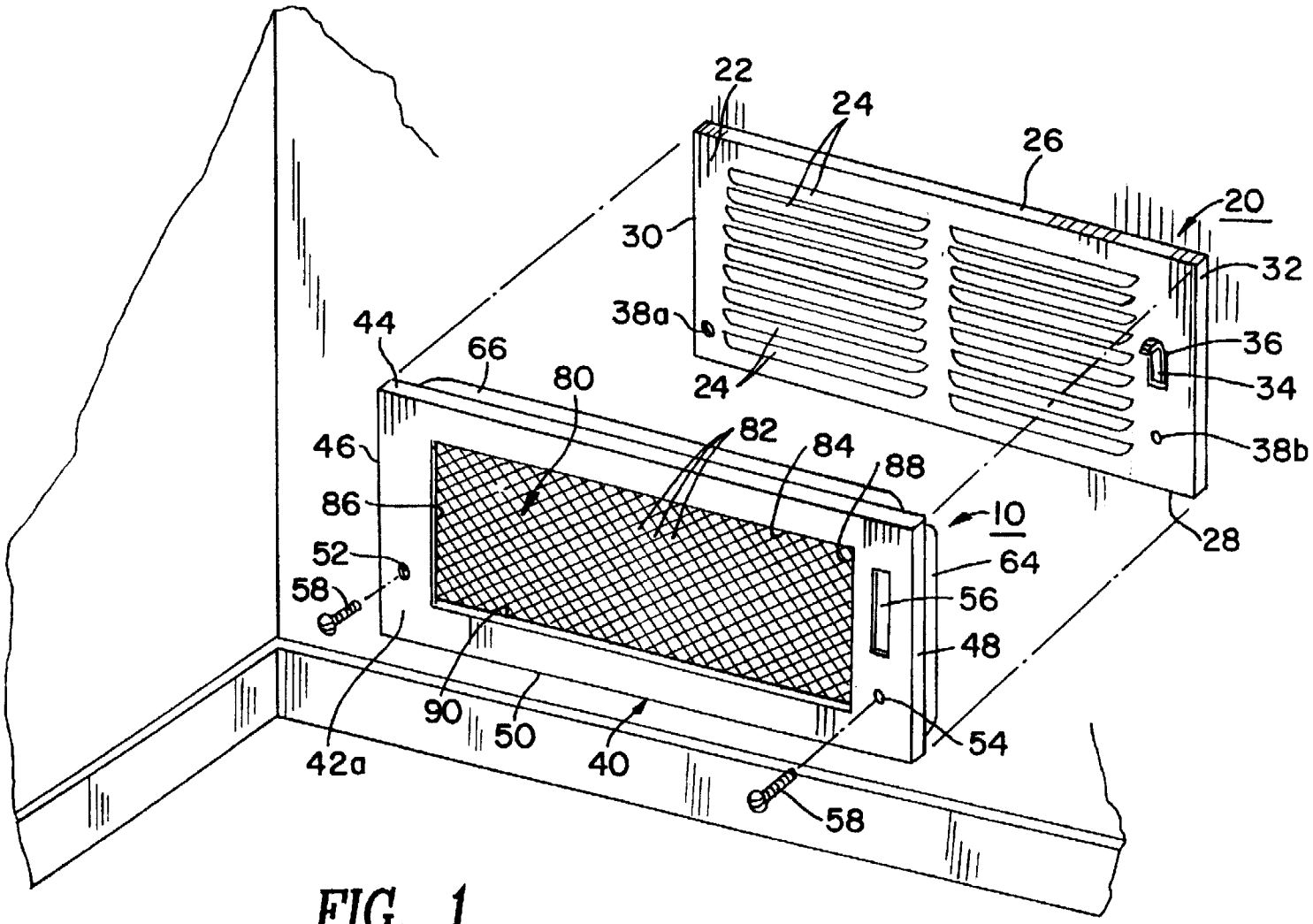
FIG. 1 is an exploded front perspective view of the protective cover of the preferred embodiment of the present invention showing its attachment to a heat register.
Figure 2:
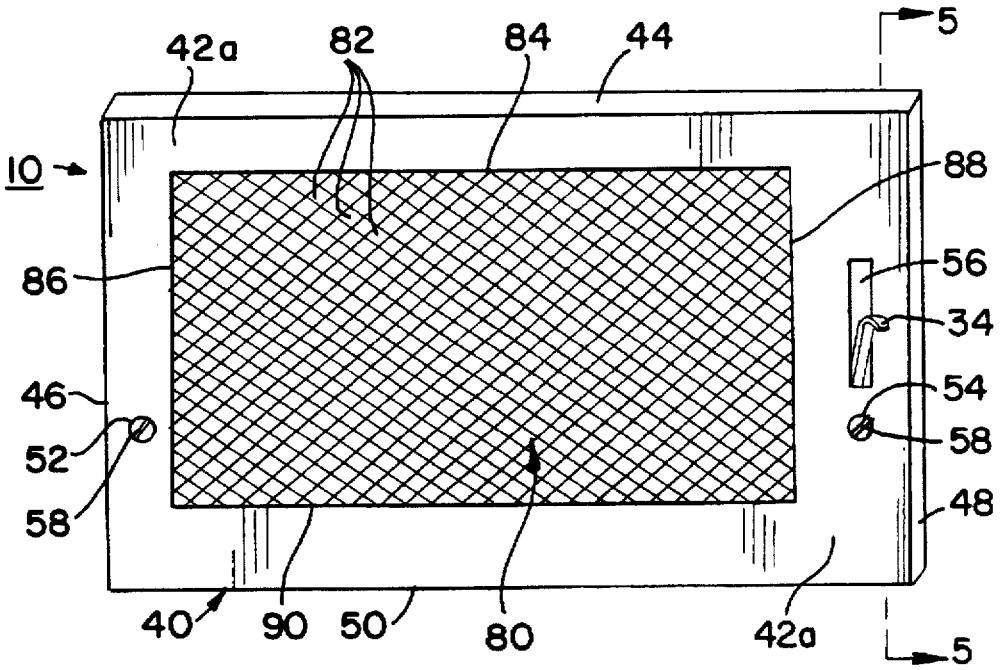
FIG. 2 is a front perspective view of the protective cover of the preferred embodiment of the present invention.

The preferred embodiment of the present invention provides for a protective cover 10 for use on a heat register 20, or heating duct, or a cooling vent, as represented in FIGS. 1 to 6. Heat register 20 includes a front surface 22, openings 24, top wall 26, bottom wall 28, and side walls 30 and 32. As shown in FIG. 1, protective cover 10 includes a main panel 40 having an open grid pattern section 80 for covering the front surface 22 of heat register 20. The main panel 40 also includes a front wall section 42 for partially covering the front surface 22 of heat register 20. Integrally attached to main panel 40 is a top wall 44, side walls 46 and 48 and bottom wall 50 for overlapping top wall 26, bottom wall 28, and side walls 30 and 32 of heat register 20. In addition, main panel 40 further includes a plurality of mounting holes 52 and 54, and a rectangular slot opening 56 for a vent lever control 34 located on front wall 42. Mounting holes 52 and 54 are used to secure protective cover 10 to heat register 20 via metal screws 58, as shown in FIGS. 1 and 2. Rectangular slot opening 56 is aligned with the lever control 34 having slot opening 36 in heat register 20.

Figure 3:
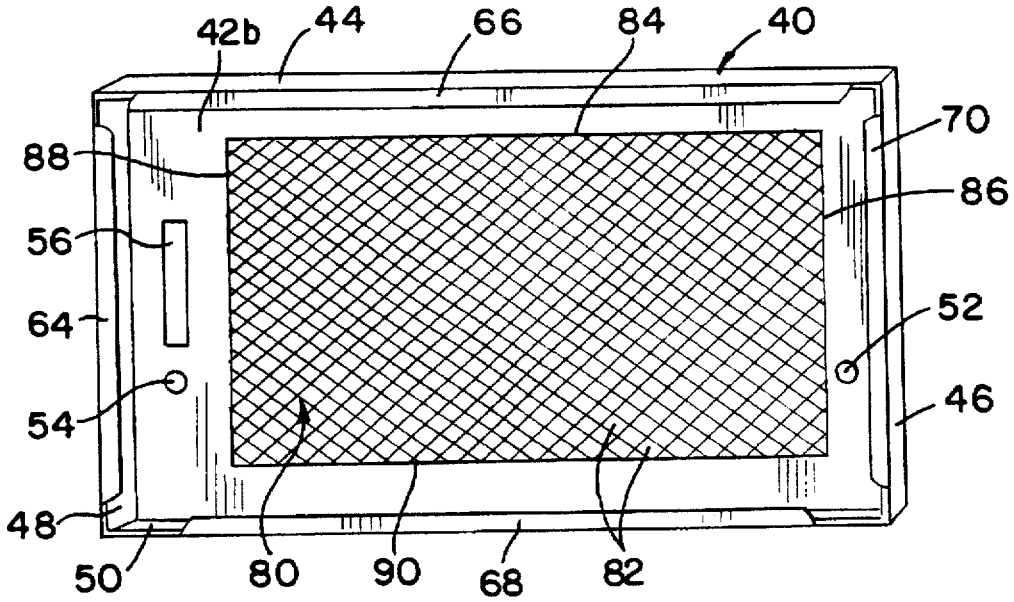
FIG. 3 is a rear perspective view of the protective cover of the preferred embodiment of the present invention.
Figure 4:
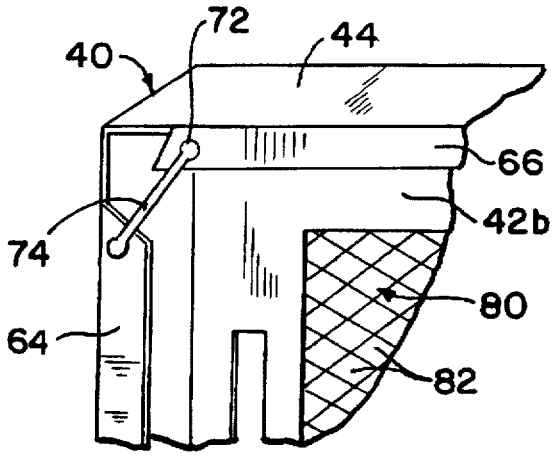
FIG. 4 is enlarged rear perspective view of the protective cover of the preferred embodiment of the present invention showing a clip for gripping onto a heat register.
Figure 5:
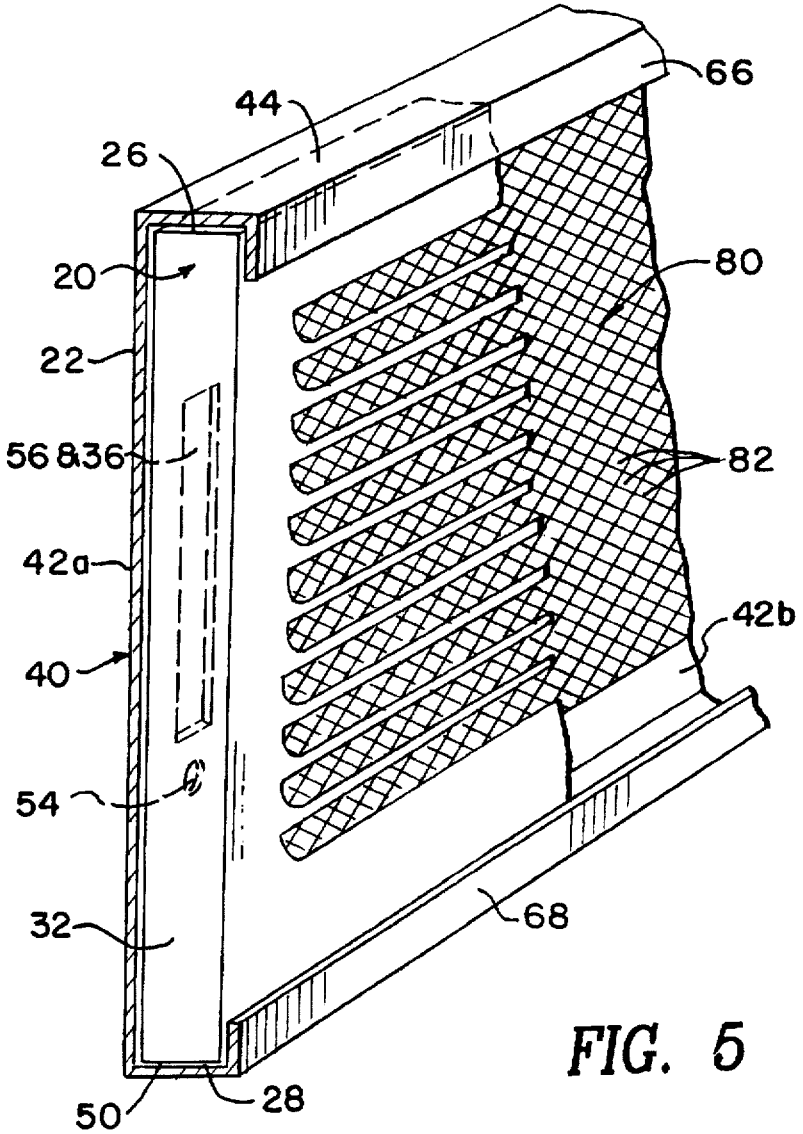
FIG. 5 is a rear cross-sectional and perspective view of the protective cover of the preferred embodiment of the present invention, taken along lines 5—5 of FIG. 2 showing the gripping members on the heat register in place which holds the protective cover on the front of the heat register.

Top, side and bottom walls 44 to 50 of main panel 40 further include integrally attached gripping members panels 64, 66, 68, and 70 being disposed at a 90° angle and parallel to main panel 40 for inserting behind the top, bottom, and side walls 26 to 32 of heat register 20, as depicted in FIGS. 3 and 5 of the drawings. As shown in FIG. 4, an additional gripping member may be employed on heat register 20, such that gripping members 66 and 68 may use a snap 72 or clip 74 for securing the gripping members onto a given corner of heat register 20.

Grid pattern section 80 having diamond-shaped openings 82 is integrally attached to the internal perimeter edges 84, 86, 88, and 90 of front wall 42 of the main panel 40. The diamond shape openings 82 are less than ¼ of an inch in width and length, such that adults, children and/or infants cannot put their fingers through openings 82 of protective cover 10 and this will prevent finger injury. The grid pattern openings can have other shapes such as in the form of ovals, squares, circles and the like.

ALTERNATE EMBODIMENT 100

Figure 6:
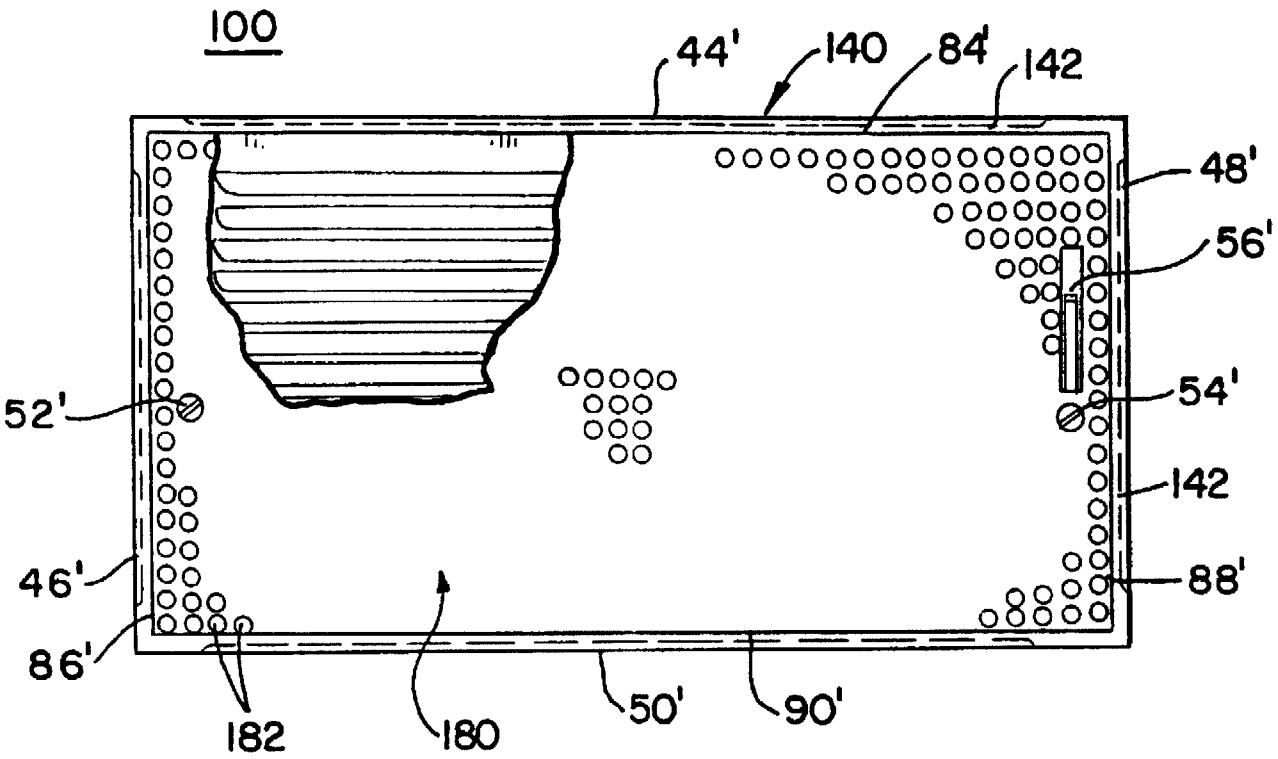
FIG. 6 is a front plan view of the protective cover of an additional embodiment of the present invention.

The alternate embodiment of protective cover 100, as depicted in FIG. 6, functions in the same manner as the preferred embodiment of protective cover 10, except for the structure and shape of the main panel 140 which has a narrower front surface wall 142 and the size of grid pattern section 180 which has circle-shaped openings 182. In a similar manner, grid pattern section 180 is also integrally attached to the internal perimeter edges 84', 86', 88', and 90' of front wall 142 of the main panel 140. In addition, open grid pattern section 180 further includes a plurality of mounting holes 52' and 54' and a rectangular slot opening 56' for a vent lever control handle 34 which is adjacent to the internal perimeter edges 86' and 88'.

OPERATION OF THE PRESENT INVENTION

The protective cover 10 or 100 is readily put into operational use by simply unfolding the gripping members 64 to 70 slightly, as depicted in FIG. 1, and inserting them behind the top, bottom and side walls 26 to 32 of heat register 20. In this manner, the front wall 42 or 142 and open grid pattern section 80 or 180 are adjacent to and cover the front surface 22 having louvered openings 24 of heat register 20. Further, the outer perimeter walls 44, 46, 48, and 50 or walls 44', 46', 48', and 50' of main panels 40 or 140 are adjacent to and overlap outer perimeter walls 26, 28, 30, and 32 of heat register 20. Protective cover 10 or 100 is then secured and firmly held in place by inserting screws 58 in mounting holes 52 and 54 or 52' and 54' and attaching the protective cover 10 or 100 to heat register 20. The vent lever control handle 34 of heat register 20 is made accessible by the alignment of slots 56 or 56' of protective cover 10 or 100 with that of slot opening 36 of heat register 20. In an alternate method of securing protective cover 10 or 100 to heat register 20, as shown in FIG. 4, snaps 72 or clips 74 can be closed onto each corner of heat register 20.

ADVANTAGES OF THE PRESENT INVENTION

Accordingly, an advantage of the present invention is that it provides for a protective covering for heat registers, heating ducts, or cooling vents that are childproof, so the covering cannot be pulled off by a child, and which prevents digit/finger injuries.

Another advantage of the present invention is that it provides for a protective covering for heat registers, heating ducts, cooling vents and the like, that are easily installed, cleaned, and with minimal labor and cost involved in the maintenance thereof.

Another advantage of the present invention is that it provides for a protective covering for heat registers, heating ducts, cooling vents and the like, that can be utilized for all types, sizes, and shapes of systems used in the home, commercial buildings or industrial plants.

Another advantage of the present invention is that it provides for a protective covering for heat registers, heating ducts, and cooling vents that may be made of various materials of construction such as wood, plastic, or metal having various shapes of openings within the cover.

A further advantage of the present invention is that it provides for a protective covering for heat registers, heating ducts, and cooling vents that may be massed produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A protective cover for covering heat registers, comprising:

a) a main panel having a flat configuration and an open grid pattern for covering the surface of a register;

b) rectangular side walls connected to said main panel for overlapping the respective sides of the register; and c) gripping members extending in a plane parallel to said main panel and connected to said side walls for inserting behind the register, to hold said protective cover in place.

2. A protective cover in accordance with claim 1, wherein said main panel has a slot for receiving a lever.

3. A protective cover in accordance with claim 1, further including means for holding said gripping members together.

4. A protective cover in accordance with claim 1, wherein said main panel has holes for receiving screws.

5. A protective cover in accordance with claim 1, wherein said main panel is formed entirely of a grid pattern.

6. A protective cover in accordance with claim 1, wherein said open grid pattern is formed of a mesh material having openings to allow air to pass through, said openings being smaller than a child's fingers.

7. A protective cover in accordance with claim 1, wherein said openings are less than ¼" in width and length.

8. A protective cover in accordance with claim 1, wherein said protective cover is formed of wood, plastic, or metal.

9. A protective cover in accordance with claim 1, wherein there are four side walls connected to said main panel.

10. A protective cover in accordance with claim 9, wherein there are four gripping members connected to said four side walls, respectively, said side walls are perpendicular to said main panel, and said gripping members are parallel to said main panel.

11. A protective cover in accordance with claim 6, wherein said openings of said open grid pattern are in the shape of diamonds, squares, ovals, or circles.

* * * * *